US005945951A

United States Patent [19]

Monte et al.

[11] Patent Number: 5,945,951

[45] Date of Patent: Aug. 31, 1999

[54] HIGH ISOLATION DUAL POLARIZED ANTENNA SYSTEM WITH MICROSTRIP-FED APERTURE COUPLED PATCHES

[75] Inventors: Thomas D. Monte, Lockport; Ronald J. Brandau, Tinley Park, both of Ill.

[73] Assignee: Andrew Corporation, Orland Park, Ill.

[21] Appl. No.: 09/144,598

[22] Filed: Aug. 31, 1998

Related U.S. Application Data

[60] Provisional application No. 60/056,311, Sep. 3, 1997.

[51] Int. Cl.[6] ..... H01Q 1/38

[52] U.S. Cl. ..... 343/700 MS; 343/797

[58] Field of Search ..... 343/700 MS, 795, 343/797, 852, 853, 810, 816, 815, 817, 818, 833, 834

[56] References Cited

U.S. PATENT DOCUMENTS 5,691,734 11/1997 Davies ..... 343/797

*Primary Examiner*—Don Wong
*Assistant Examiner*—Hoang Nguyen
*Attorney, Agent, or Firm*—Arnold White & Durkee

[57] ABSTRACT

A dual polarized antenna on a printed circuit board, the antenna comprises a plurality of orthogonally placed microstrip lines; a plurality of parasitic coupling strips; a feed network, the feed network being connected to the plurality of orthogonally displaced microstrip lines, at least some of the microstrip lines having selected ones of the plurality of parasitic coupling strips placed over at least a portion of the microstrip lines, the microstrip lines receiving electromagnetic signals; a bay, the bay covered by a thin layer of conductive material; and a radiating patch, the radiating patch displaced adjacent the bay by a plurality of standoffs, the electromagnetic signals coupling through the bay and exciting the radiating patch, the radiating patch producing first electromagnetic fields, the first electromagnetic fields exciting currents in the parasitic coupling strip, the currents creating second electromagnetic fields, the second electromagnetic fields canceling with the first electromagnetic fields.

20 Claims, 5 Drawing Sheets

HIGH ISOLATION DUAL POLARIZED ANTENNA SYSTEM WITH MICROSTRIP-FED APERTURE COUPLED PATCHES

CROSS REFERENCES TO RELATED APPLICATIONS

This is a complete application claiming the benefits of co-pending provisional U.S. patent application Ser. No. 60/056,311 filed on Sep. 3, 1997.

BACKGROUND OF THE INVENTION

Base stations used in wireless telecommunication systems have the capability to receive linear polarized electromagnetic signals. These signals are then processed by a receiver at the base station and fed into the telephone network. In practice, the same antenna which receives the signals can also be used to transmit signals if the transmitted signals are at different frequencies than the received signals.

Wireless telecommunication systems suffer from the problem of multi-path fading. Diversity reception is often used to overcome the problem of severe multi-path fading. A diversity technique requires at least two signal paths that carry the same information but have uncorrelated multi-path fadings. Several types of diversity reception are used at base stations in the telecommunications industry including space diversity, direction diversity, polarization diversity, frequency diversity, and time diversity. A space diversity system receives signals from different points in space requiring two antennas separated by a significant distance. Polarization diversity uses orthogonal polarization to provide uncorrelated paths.

As is well-known in the art, the sense or direction of polarization of an antenna is measured from a fixed axis and can vary, depending upon system requirements. In particular, the sense of polarization can range from vertical polarization (0 degrees) to horizontal polarization (90 degrees). Currently, the most prevalent types of polarization used in systems are those which use vertical/horizontal and +45°/−45° polarization ("slant 45°"). However, other angles of polarization can be used. If an antenna receives or transmits signals of two polarizations normally orthogonal, they are also known as dual polarized antennas.

Dual polarized antennas have to meet a certain port-to-port coupling or isolation specification. The typical port-to-port isolation specification is −30 dB. Furthermore, many dual polarized antennas are designed with microstrip lines integrated with aperture coupled radiating patches due to the associated lower manufacturing cost and the desirable slim profile. The present invention discloses a means to lower the port-to-port isolation of dual polarized antenna systems with some simple parasitic coupling strips placed on the non-radiative side of the panel antenna.

Generally, dual polarized antennas must meet the −30 dB isolation specification in order to be marketable. Not meeting the specification means the system integrator might have to use higher performance filters which cost more and decrease antenna gain. The present invention overcomes these concerns because it meets the −30 dB isolation specification.

Moreover, the visual impact of base station towers on communities has become a societal concern. It has become desirable to reduce the size of these towers and thereby lessen the visual impact of the towers on the community. The size and scale of the towers can be reduced by using base station towers with fewer antennas. This can be achieved if dual polarized antennas and polarization diversity are used. Such systems replace systems using space diversity which require pairs of vertically polarized antennas. Some studies indicate that, for urban environments, polarization diversity provides an equivalent signal quality to space diversity. With the majority of base station sites located in urban environments, it is likely that dual polarized antennas will be used in place of the conventional pairs of vertically polarized antennas.

SUMMARY OF THE INVENTION

It is a principle object of the present invention to provide an antenna array comprised of feed networks connected to orthogonally displaced microstrip lines and at least some of those microstrip lines having parasitic coupling strips placed over at least part of one of the microstrip lines.

It is a further object of the invention to provide an antenna array which produces dual polarized signals.

It is another object of the invention to provide an antenna array which improves isolation between the sum of one set of like-polarized signals and the sum of the orthogonal set of polarized signals.

It is yet another object of the invention to provide an antenna that minimizes the number of antennas required thereby providing an aesthetically pleasing structure that is of minimum size and scale.

It is a further object of the invention to provide for a port-to-port isolation specification of approximately −30 dB.

It is another object of the invention to provide for a more compact dual polarized antenna.

It is yet another object of the present invention to provide an antenna capable of approximately −30 dB isolation in an 85 degree azimuthal half power beam width ("HPBW") model.

It is a further object of the present invention to provide an antenna capable of canceling out the residual coupling of the antenna system via a parasitic coupling strip on the non-radiating side of the PCB so the side lobes of the antenna are unaffected.

These and other objects of the invention are provided by an improved antenna system comprising a feed network, the feed network being connected to orthogonally displaced microstrip lines and at least some of those microstrip lines having parasitic coupling strips placed over at least part of one of the microstrip lines, a radiating patch, displaced adjacent the bay by standoffs, producing first electromagnetic fields, the first electromagnetic fields exciting currents in the parasitic coupling strip, the currents creating second electromagnetic fields, the second electromagnetic fields canceling with the first electromagnetic fields.

DETAILED DESCRIPTION OF THE PREFERRED EMBODIMENT

The present invention is useful in cellular communication systems. One embodiment of the present invention operates in the cellular band of frequencies of 820–960 MHz. Generally, cellular telephone users transmit an electromagnetic signal to a base station which includes a plurality of antennas. Although useful in cellular base stations, the present invention can also be used in all types of antenna systems.

Figure 1A:
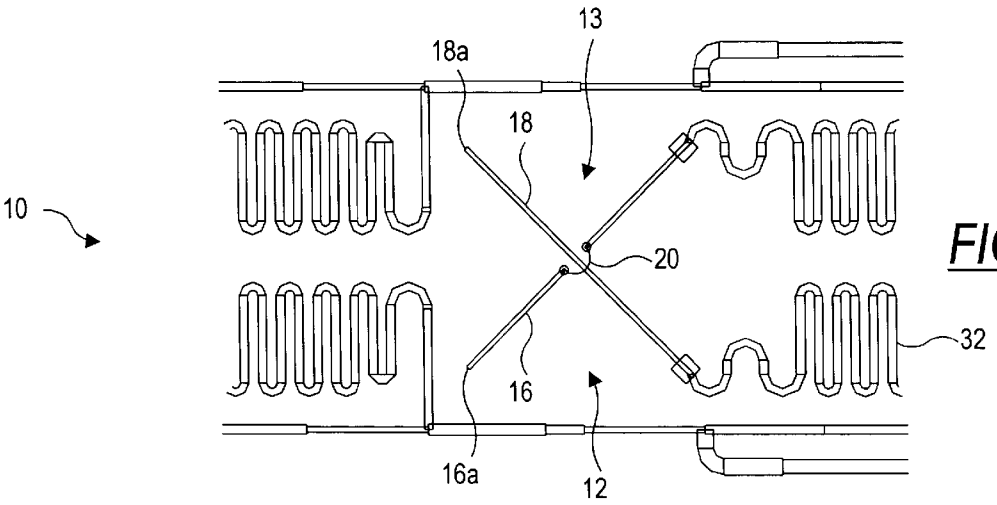
FIG. 1*a* is a top view of a first side of a printed circuit board including a feed network and a pair of generally orthogonal microstrip lines.
Figure 1B:
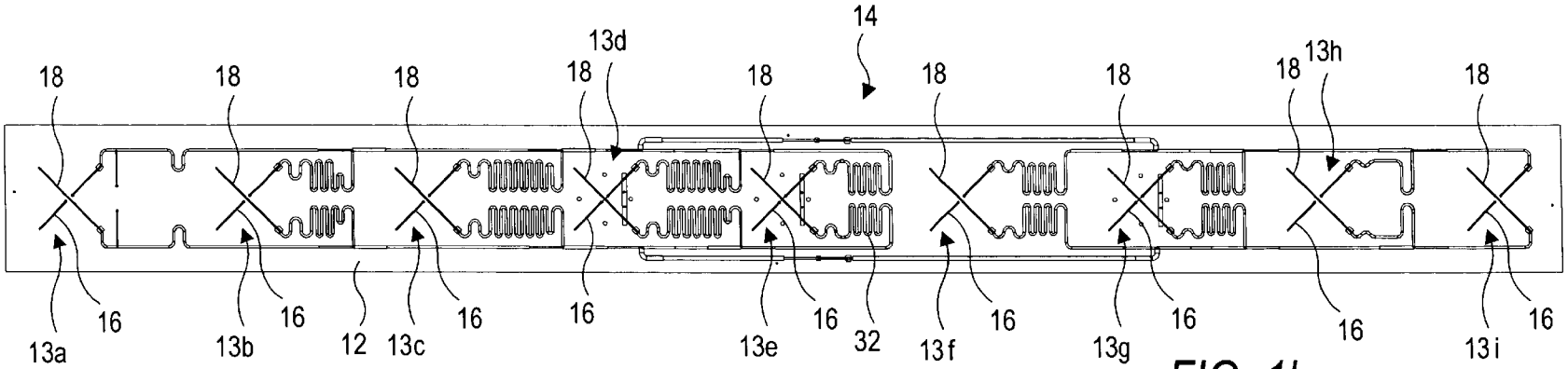
FIG. 1*b* is a top view of a first side of a printed circuit board including nine generally orthogonal pairs of microstrip lines.

Referring now to FIGS. 1*a* and 1*b,* a dual polarized antenna 10 is formed on a first side of printed circuit board ("PCB") 12. In one embodiment, PCB 12 is approximately 0.062" thick with a dielectric constant of 3.0. One side of PCB 12 contains generally orthogonal pairs of microstrip lines 13*a–i* and feed network 14. Feed network 14 connects to microstrip lines 16 and 18, each producing one polarization. The generally orthogonal microstrips feed two polarizations that are orthogonal. Thus, it is not critical that the microstrips are orthogonal, but only that the microstrips feed two polarizations that are orthogonal. Those skilled in the art could design different configurations of microstrips that achieve two orthogonal polarizations. Therefore, the present discussion will only focus on the illustrated embodiment where there are pairs of generally orthogonal microstrips.

Figure 3D:
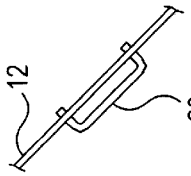
FIG. 3*d* is a partial side cross-sectional view of the jumper of FIG. 1*a;*

In one embodiment of the invention, antenna 10 terminates in nine open circuits illustrated by the microstrip pair 16 and 18 at the end of microstrips 16 and 18 at 16*a* and 18*a,* respectively. Microstrip lines 16 and 18 are essentially mirror images of each other. However, microstrip lines 16 and 18 do not intersect each other. Rather, microstrip line 16 is discontinuous. A first part of microstrip line 16 is connected via a jumper, illustrated in FIG. 3*d,* to a second part of microstrip line 16 with a soldered wire 20 to avoid contact with microstrip line 18. As shown in FIG. 1*a,* microstrip lines 16 and 18 are approximately perpendicular to each other. However, other configurations are possible to optimize the performance of the antenna.

As shown in FIG. 1*b,* nine generally orthogonal pairs of microstrip lines 13*a,* 13*b,* 13*c,* 13*d,* 13*e,* 13*f,* 13*g,* 13*h,* and 13*i* are arrayed to form one antenna. Delay lines 32 lead to the microstrip lines and provide a phase delay so that all the generally orthogonal pairs of microstrip lines receive or transmit in phase.

Figure 2A:
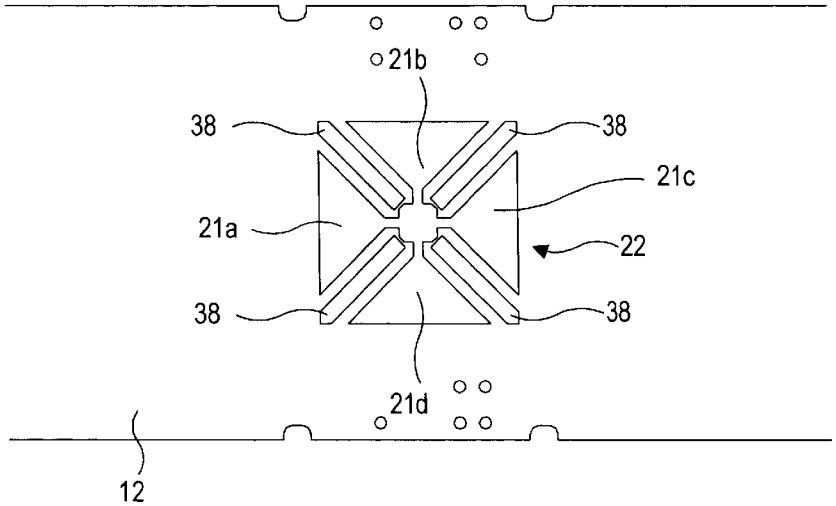
FIG. 2*a* is a top view of a second side of the printed circuit board of FIG. 1*a;*
Figure 2B:
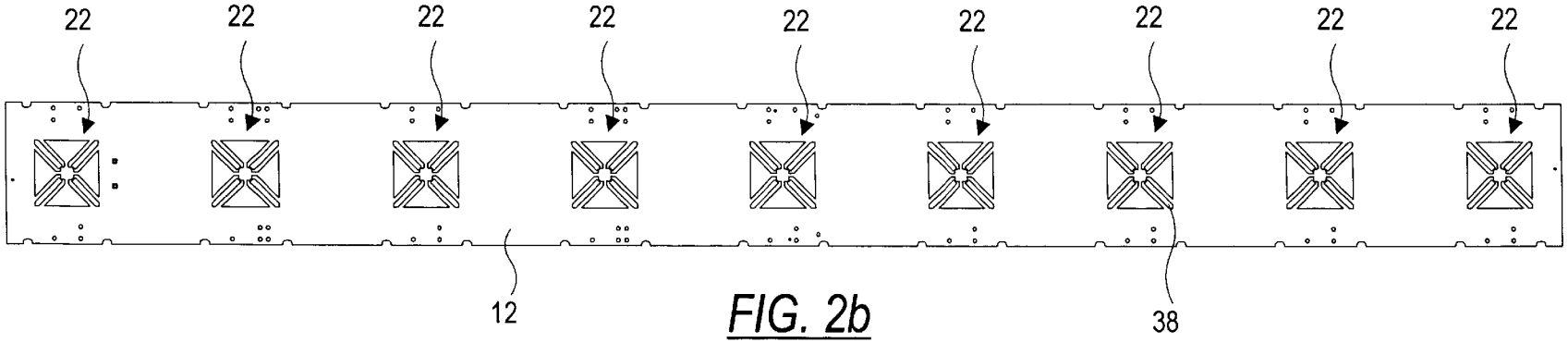
FIG. 2*b* is a top view of a second side of the printed circuit board of FIG. 1*b;*
Figure 3C:
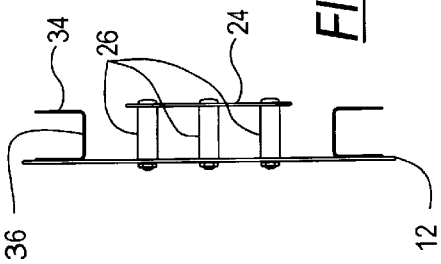
FIG. 3*c* is a side view showing a radiating patch displaced from the printed circuit board of FIG. 2*b;*

Referring now to FIGS. 2*a* and 2*b,* a second side of PCB 12, except for bay 22, is covered by a thin layer of conductive material such as copper. Bay 22 is a non-conductive area formed by removing the copper from a four leaf clover area on the PCB. That area extends to the four triangular areas 21*a–d* expending from the center of the clover leaf area. In addition, slots 38 are also a non-conductive area formed by removing the copper from the second side of PCB 12. The electromagnetic signal couples through bay 22 and excites a conductive radiating patch 24 set off from the PCB with dielectric standoffs 26, both shown in FIGS. 3*b* & 3*c*. In another embodiment, the standoffs 26 of FIGS. 3*b* & 3*c* can be replaced by dielectric foam. There is a certain amount of electromagnetic coupling between ports 28 of bay 22 due to the asymmetrical feed network employed.

Figure 3B:
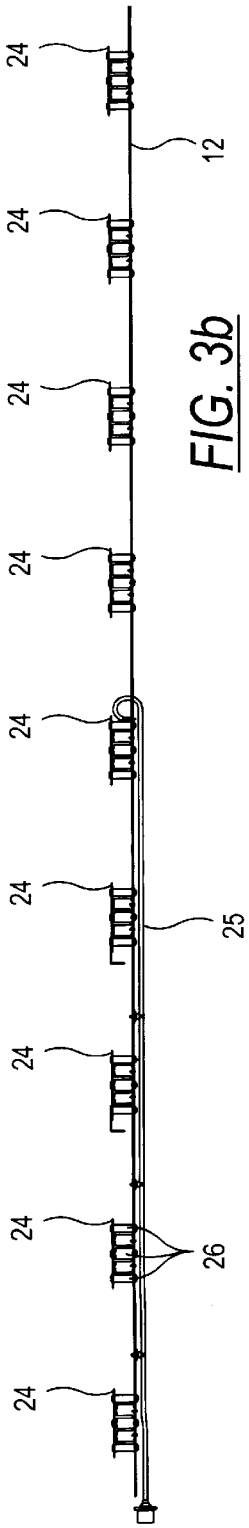
FIG. 3*b* is a side view showing a radiating patch displaced from the printed circuit board of FIG. 2*b;*
Figure 3A:
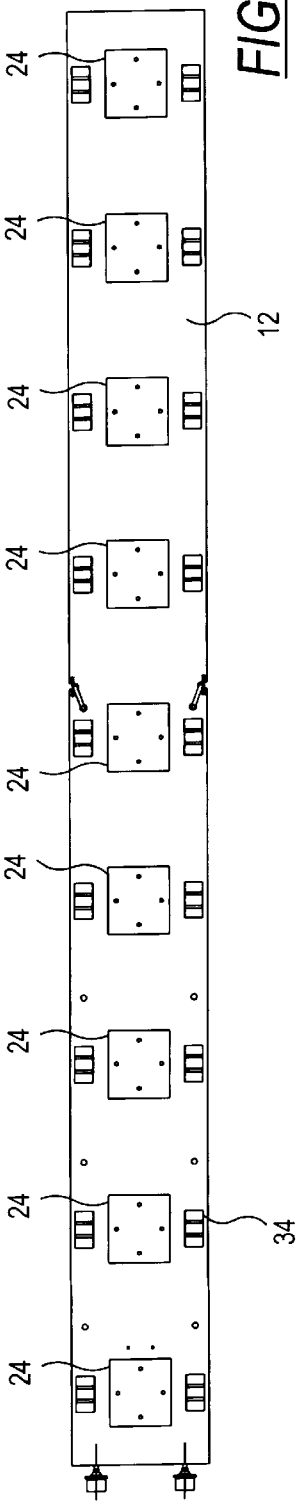
FIG. 3*a* is a top view of the radiating patches and their corresponding parasitic flaps.

Shown in FIGS. 3*a* & 3*b* is a top view and a side view, respectively, of the radiating patches 24. FIG. 3*b* also shows a coaxial cable which electrical connects the antenna to a receiver or transmitter. Shown in FIG. 3*a* are parasitic flaps 34. Parasitic flaps 24 are attached to PCB 12 by plastic supports 36 shown in the side view of FIG. 3*c*. Radiating patch 24, shown in the side view of FIG. 3*c* and the top view of FIG. 3*a,* obscures bay 22 shown in FIG. 2*a*. Parasitic flaps 34, shown in FIGS. 3*c* and 3*a,* provide for a broader beam. Thus, parasitic flaps 34 provide for the broader 85 degree azimuthal HPBW model. However, the introduction of parasitic flaps 34 introduce an isolation problem into the antenna system. That isolation problem could not be compensated for by the prior parasitic wire configurations of other panel antennas. Therefore, the introduction of parasitic flaps 34 require the introduction of parasitic coupling strip 30 in order to cancel out the residual coupling of the antenna system and achieve an isolation of −30 dB.

Figure 4A:
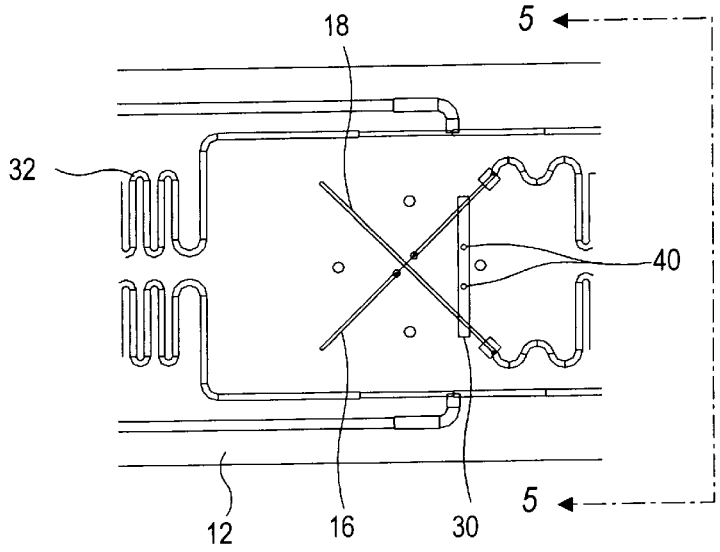
FIG. 4*a* is a top view of the first side of the printed circuit board showing a parasitic coupling strip over an orthogonal pair of microstrip lines.

Referring to FIG. 4*a,* the first side of PCB 12 is illustrated and the parasitic coupling strip 30 is placed over microstrips 16 and 18. The first side of PCB 12 is the non-radiating side. Therefore, the introduction of parasitic coupling strip 30 does not change the side lobes of the present antenna. This is unlike the effect parasitic wires have on the side lobes of antennas using such wires for isolation. Antennas that use parasitic wires incorporate them on the radiating side of the antenna and thus the wires contribute to distorting the antenna's side lobes. This disadvantage is overcome by the use of parasitic coupling strip 30.

Figure 4B:
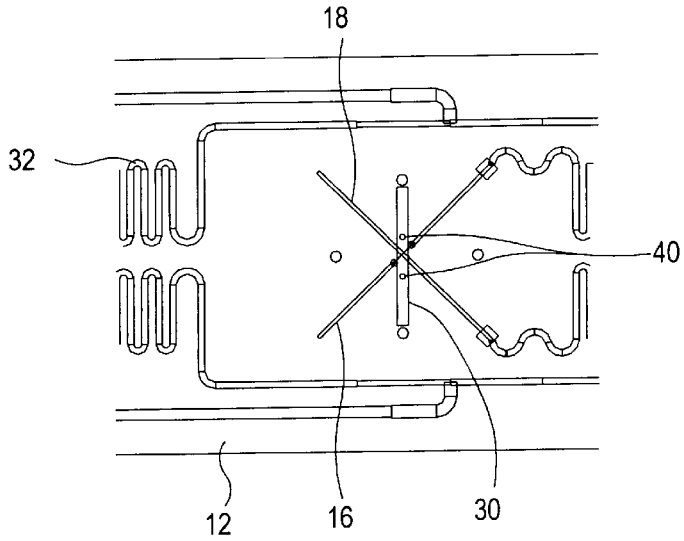
FIG. 4*b* is a top view of the first side of the printed circuit board showing a parasitic coupling strip over an orthogonal pair of microstrip lines.
Figure 4C:
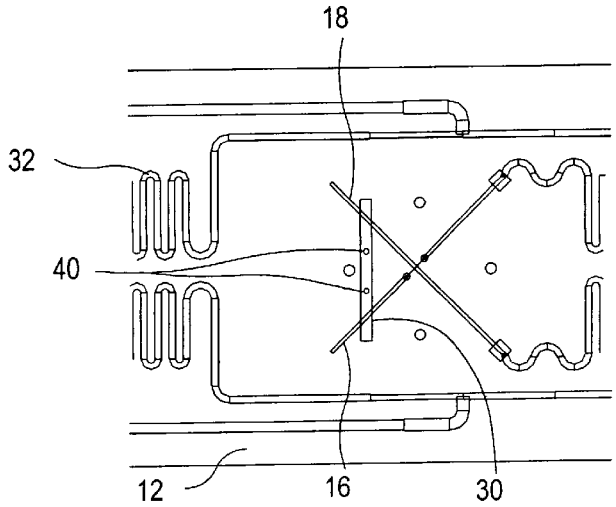
FIG. 4*c* is a top view of the first side of the printed circuit board showing a parasitic coupling strip over an orthogonal pair of microstrip lines.
Figure 5:
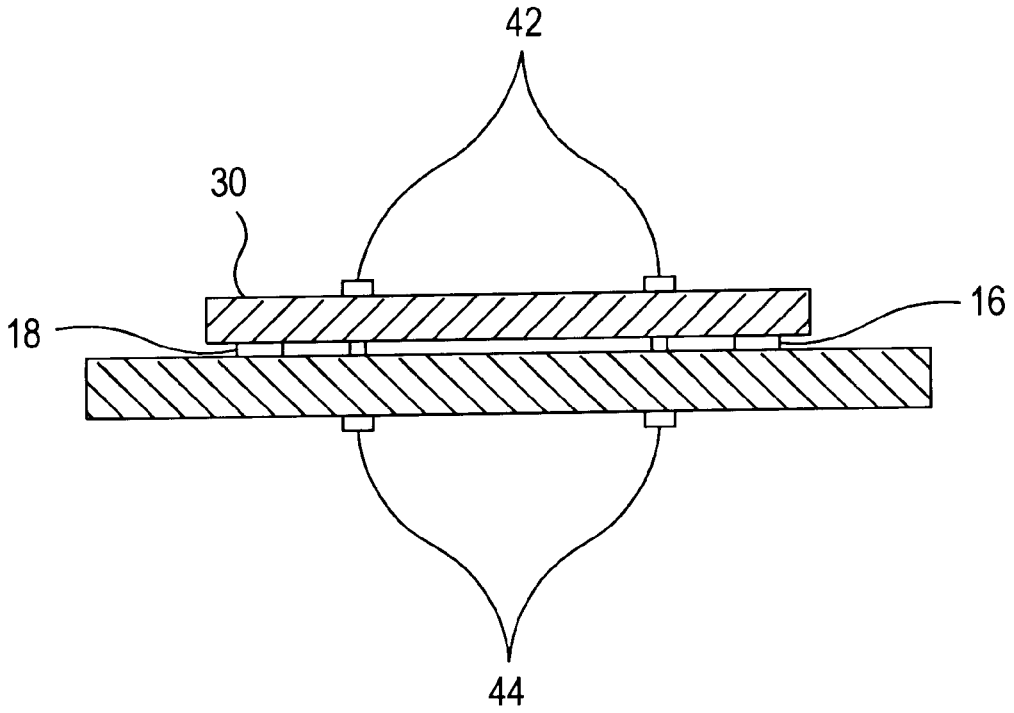
FIG. 5 is a cross-sectional view about line 5—5 of FIG. 4*a*.

Parasitic coupling strip 30 is made from the same dielectric PCB material that PCB 12 is made from, with a conductive material such as copper on one side only. In one embodiment, the parasitic coupling strip 30 is 3.125" long by 0.250" wide. As shown in FIG. 4*a,* parasitic coupling strip 30 is placed over microstrip lines 16 and 18 on the delay line side of the jumpered intersection of the microstrip lines. In this embodiment, parasitic coupling strip 30 is attached to PCB 12 by two nylon bolts 42 displaced through the two holes 40 shown on parasitic coupling strip 30 in FIGS. 4*a–c*. These bolts 42 are secured by two nuts 44 on the second side of PCB 12, shown in FIG. 5. Parasitic coupling strip 30 rests on microstrips 16 and 18, as shown in FIG. 5. However, in another embodiment, parasitic coupling strip 30 is secured to PCB 12 by adhesive, thus dispensing with the two holes 40 in parasitic coupling strip 30 shown in FIGS. 4*a–c*. Parasitic coupling strip 30 is placed with the copper side away from microstrip lines 16 and 18. The signal is coupled from one polarization to the other without degrading radiation patch 24 return loss (VSWR). In this way, the present invention improves the antenna port-to-port isolation of the 85 degree azimuthal HPBW model by approximately −8 dB, from −19 dB to −27.5 dB. Additionally, the present invention does not have any metal to metal contacts which can degrade the Inter-Modulation Distortion ("IMD") levels of the antenna.

Furthermore, the placement of the parasitic coupling strip can be altered and still achieve the objectives of the invention. For example, in one embodiment, the parasitic coupling strip can be over the two microstrip lines on the delay line side of the jumpered intersection of the microstrip lines as described above and shown in FIG. 4*a*. In another embodiment, the parasitic coupling strip can be over the jumpered intersection of the two microstrip lines, as shown in FIG. 4*b*. In a further embodiment, the parasitic coupling strip can be over the two microstrip lines on the side opposite the delay line side, as shown in FIG. 4*c*.

Next, the operation of the above described antenna system will be detailed below.

The geometry of the generally orthogonal pairs of microstrip lines determines the radiation characteristics, the beam width, and the impedance of antenna 10. Moreover, the feed network and microstrip line pairs described herein can act as both a receiver and a transmitter provided that the transmitted signal is at a different frequency than the received signal.

In order for currents to be induced, the parasitic coupling strip 30 is conductive. A primary electromagnetic wave or field incident upon the antenna array induces currents on the surfaces of the microstrip lines 16 and 18 and the parasitic coupling strip 30. These induced currents create a weaker secondary electromagnetic field which will combine with the primary electromagnetic field. A state of equilibrium will occur such that the final electromagnetic field is different from the primary electromagnetic field. The dimension and position of the parasitic coupling strip 30 are factors in determining the final field. In other words, the improved isolation of the present invention is achieved by currents excited on the parasitic coupling strip 30 which re-radiate energy that cancels the energy which couples from one polarization to the other causing the isolation to be at a minimum.

The parasitic coupling strips are placed over at least some of the generally orthogonal pairs of the microstrip lines of the antenna array 10. However, parasitic coupling strips are not necessarily placed over every orthogonal pair of microstrip lines in the array. Rather, a network analyzer is used to determine the optimum number and positioning of the parasitic coupling strips. In particular, the network analyzer is employed such that the isolation of any given configuration of radiating patches and parasitic coupling strips can be measured. In the embodiment of FIG. 1*b*, three of the nine generally orthogonal pairs of microstrip lines are shown with a parasitic element.

The parasitic coupling strips are situated so as to cause no undue side effects such as degradation of the return loss (VSWR) nor do the parasitic coupling strips unduly disturb the normal antenna array radiation patterns.

Two illustrative models were tested to determine the azimuthal half power beam width ("HPBW"). In the first test, the 68 degree azimuthal half power beam width ("HPBW") model measured an approximately −23 dB residual coupling between ports 28 of bay 22 of FIGS. 2*a–b*. The introduction of parasitic coupling strip 30 improves the residual coupling between ports 28 of bay 22 from −23 dB to −30 dB.

In contrast, the second test revealed that the 85 degree azimuthal HPBW model exhibited coupling much higher, approximately −19 dB. The present invention improves the antenna port-to-port isolation of the 85 degree azimuthal HPBW model by approximately −8 dB, from −19 dB to −27.5 dB. Moreover, improved isolation on the 68 degree model was also achieved with the use of parasitic coupling strip 30 of the present invention. Parasitic coupling strip 30 is displaced adjacent to radiating patch 24 so as to couple energy from one polarization to the other and cancel out the residual coupling of the antenna system. Moreover, parasitic coupling strip 30 couples the electromagnetic signal between the polarizations without adversely affecting the return loss (VSWR) of radiating patch 24. If the return loss of the radiating patch 24 is degraded, the antenna distribution is also degraded thus decreasing the antenna gain and increasing the side lobes. The present invention overcomes these disadvantages. Furthermore, the parasitic coupling strip 30 of the present invention does not degrade the cross polarization level of the antenna.

Thus, a dual polarized antenna array is provided which includes feed networks connected to orthogonally displaced microstrip lines and at least some of those microstrip lines having parasitic coupling strips placed over at least part of one of the microstrip lines. The resulting antenna array produces dual polarized signals, improves isolation between the sum of one set of like-polarized signals and the sum of the orthogonal set of polarized signals, minimizes the number of antennas required thereby providing an aesthetically pleasing structure that is of minimum size and scale, provides for a port-to-port isolation specification of approximately −30 dB, provides for a more compact dual polarized antenna, provides an antenna capable of approximately −30 dB isolation in an 85 degree azimuthal half power beam width ("HPBW") model and provides an antenna capable of canceling out the residual coupling of the antenna system via a parasitic coupling strip on the non-radiating side of the PCB so the side lobes of the antenna are unaffected.

While the present invention has been described with reference to one or more embodiments, those skilled in the art will recognize that many changes may be made thereto without departing from the spirit and scope of the present invention.

What is claimed is:

1. A dual polarized antenna on a printed circuit board and associated port-to-port isolation, said antenna comprising:

a plurality of orthogonally placed microstrip lines;

a plurality of parasitic coupling strips;

a feed network, said feed network being connected to said plurality of orthogonally displaced microstrip lines, at least some of said microstrip lines having selected ones of said plurality of parasitic coupling strips placed over at least a portion of said microstrip lines, said microstrip lines receiving electromagnetic signals;

a bay, said bay covered by a thin layer of conductive material; and a radiating patch, said radiating patch displaced adjacent said bay by standoff means, said electromagnetic signals coupling through said bay and exciting said radiating patch, said radiating patch producing first electromagnetic fields, the first electromagnetic fields exciting currents in the parasitic coupling strip, said currents creating second electromagnetic fields, said second electromagnetic fields canceling with the first electromagnetic fields.

2. The dual polarized antenna of claim 1 wherein said standoff means is comprised of foam.

3. The dual polarized antenna of claim 1 wherein said standoff means is comprised of a plurality of standoffs.

4. The dual polarized antenna of claim 1 wherein said microstrip lines are placed in orthogonal pairs.

5. The dual polarized antenna of claim 1 wherein said bays are comprised of copper.

6. The dual polarized antenna of claim 1 wherein the port-to-port isolation achieved is approximately −30 dB.

7. The dual polarized antenna of claim 1 further including parasitic flaps coupled to said printed circuit board.

8. A dual polarized antenna and associated port-to-port isolation, said antenna comprising:

a printed circuit board with first and second sides, said first side comprising a plurality of orthogonally placed first and second microstrip lines, said microstrip lines placed in orthogonal pairs, said first microstrip line comprising two sections coupled using a jumper;

a plurality of parasitic coupling strips;

a feed network, said feed network being connected to said plurality of orthogonally displaced microstrip lines, at least some of said microstrip lines having selected ones of said plurality of parasitic coupling strips placed over at least a portion of said microstrip lines, said microstrip lines receiving electromagnetic signals;

a second side of the printed circuit board comprising a bay, said bay covered by a thin layer of conductive material; and a radiating patch, said radiating patch displaced adjacent said bay by standoff means, said electromagnetic signals coupling through said bay and exciting said radiating patch, said radiating patch producing first electromagnetic fields, the first electromagnetic fields exciting currents in the parasitic coupling strip, said currents creating second electromagnetic fields, said second electromagnetic fields canceling with the first electromagnetic fields.

9. The dual polarized antenna of claim 8 wherein said standoff means is comprised of foam.

10. The dual polarized antenna of claim 8 wherein said standoff means is comprised of a plurality of standoffs.

11. The dual polarized antenna of claim 8 wherein said bays are comprised of copper.

12. The dual polarized antenna of claim 8 wherein the port-to-port isolation achieved is approximately −30 dB.

13. The dual polarized antenna of claim 8 further including parasitic flaps coupled to said printed circuit board.

14. A method of receiving and transmitting electromagnetic signals using a dual polarized antenna, said antenna having a port-to-port isolation, comprising the steps of:

providing a plurality of orthogonally placed microstrip lines;

providing a plurality of parasitic coupling strips;

providing a feed network, connecting said feed network to said plurality of orthogonally displaced microstrip lines;

placing selected ones of said parasitic coupling strips over at least a portion of some of said microstrip lines;

providing a bay, and covering said bay with a thin layer of conductive material;

providing a radiating patch, and displacing said radiating patch adjacent said bay by using a plurality of standoffs;

applying electromagnetic signals to said microstrip lines;

coupling said electromagnetic signals through said bay and exciting said radiating patch;

producing first electromagnetic fields in response to said excitation;

exciting currents with said first electromagnetic fields in the parasitic coupling strip;

creating second electromagnetic fields with said currents;

canceling said first electromagnetic fields with said second electromagnetic fields.

15. The method of claim 14 wherein said microstrip lines are placed in orthogonal pairs.

16. The method of claim 14 wherein said bays are comprised of copper.

17. The method of claim 14 wherein the port-to-port isolation achieved is approximately −30 dB.

18. The method of claim 14 further comprising the step to determine the optimum number and positioning of said parasitic coupling strips.

19. The method of claim 18 wherein said network analyzer is employed such that the isolation of any given configuration of radiating patches and parasitic coupling strips can be measured and said parasitic coupling strips are situated so as to cause no undue side effects such as degradation of the return loss (VSWR).

20. A dual polarized antenna, said antenna comprising:

a printed circuit board with first and second sides, said first side comprising a plurality of orthogonally placed first and second microstrip lines, said microstrip lines placed in orthogonal pairs, said first microstrip line comprising two sections coupled using a jumper;

a plurality of parasitic coupling strips;

a feed network, said feed network being connected to said plurality of orthogonally displaced microstrip lines, at least some of said microstrip lines having selected ones of said plurality of parasitic coupling strips placed over at least a portion of said microstrip lines, said microstrip lines receiving electromagnetic signals;

a second side of the printed circuit board comprising a bay, said bay covered by a thin layer of copper;

parasitic flaps coupled to said printed circuit board;

a radiating patch, said radiating patch displaced adjacent said bay by a plurality of standoffs, said electromagnetic signals coupling through said bay and exciting said radiating patch, said radiating patch producing first electromagnetic fields, the first electromagnetic fields exciting currents in the parasitic coupling strip, said currents creating second electromagnetic fields, said second electromagnetic fields canceling with the first electromagnetic field; and wherein the port-to-port isolation achieved is approximately −30 dB.

* * * * *